United States Patent [19]

Folgerö et al.

[11] 3,991,263

[45] *Nov. 9, 1976

[54] MEANS FOR TAPPING

[75] Inventors: Kåre Folgerö; Bengt Fredrikson, both of Vasteras, Sweden

[73] Assignee: Allmanna Svenska Elektriska Aktiebolaget, Vasteras, Sweden

[ * ] Notice: The portion of the term of this patent subsequent to Nov. 26, 1991, has been disclaimed.

[22] Filed: Aug. 29, 1974

[21] Appl. No.: 501,764

[30] Foreign Application Priority Data

Sept. 3, 1973 Sweden ..... 7311938

[52] U.S. Cl. ..... 13/26; 13/33; 164/281 R; 266/217; 164/335; 164/337

[51] Int. Cl.[2] ..... H05B 5/00

[58] Field of Search ..... 249/105, 108; 164/281, 164/335, 337; 13/26, 29; 266/34 V

[56] References Cited

UNITED STATES PATENTS

| | | | |
|---|---|---|---|
| 2,587,793 | 3/1952 | Waldron | 266/34 V X |
| 2,892,005 | 6/1959 | Long et al. | 13/33 X |
| 2,936,326 | 5/1960 | Tama | 13/29 X |
| 3,085,124 | 4/1963 | Upton | 13/33 |
| 3,179,512 | 4/1965 | Olsson | 164/281 UX |
| 3,299,481 | 1/1967 | Brotzmann | 164/281 X |
| 3,310,850 | 3/1967 | Armbruster | 266/34 V |
| 3,384,150 | 5/1968 | Newsome | 164/281 |
| 3,467,167 | 9/1969 | Mahin | 164/281 X |
| 3,685,570 | 8/1972 | Fredrikson et al. | 164/281 |
| 3,706,399 | 12/1972 | Sundberg | 164/281 |
| 3,718,175 | 2/1973 | Rinesch | 164/281 |
| 3,776,439 | 12/1973 | Settle | 164/281 |
| 3,810,564 | 5/1974 | Allyn et al. | 164/281 |

FOREIGN PATENTS OR APPLICATIONS

| | | |
|---|---|---|
| 1,384,281 | 11/1964 | France |

*Primary Examiner*—Ronald J. Shore
*Attorney, Agent, or Firm*—Kenyon & Kenyon Reilly Carr & Chapin

[57] ABSTRACT

Apparatus for melting, holding and tapping metals or metal alloys, in which solid material is melted down in a channel-type induction furnace, the melt then being transferred to a second channel-type induction furnace to be kept hot, possibly over-heated and stored, characterized in that the melting furnace is connected to the second furnace by way of a feeding channel and is located at a higher level than the second furnace and that the second furnace is in the form of a pressure furnace for pressure tapping through a spout. As a further characterizing feature, the tapping spout is provided with a tun dish in which sub-atmospheric pressures can be obtained to control the tapping through the spout.

2 Claims, 3 Drawing Figures

MEANS FOR TAPPING

The present invention relates to a means for tapping according to U.S. patent application Ser. No. 342,368 on which the Folgero et al U.S. Pat. 3,851,090 issued on Nov. 26, 1974, comprising a melting furnace and a pressure tapping furnace connected to the first-mentioned furnace by means of a charging channel, and a tapping channel connected to the last-mentioned furnace.

In this plant, which is well suited for rapid melting and homogenization of melt, it is desirable to be able to control the tapping, for example in connection with continuous casting, and to be able to slow down the rate of tapping when necessary.

This invention being a further development of the mentioned earlier invention constitutes a solution to these problems and is characterized in that a tundish provided with at least one pouring hole is connected to the tapping channel and the tundish is provided with at least one evacuation conduit for achieving negative (sub-atmospheric) pressure above the melt surface in the tundish, with a view to controlling the tapping through the pouring hole. With such a means it will be possible in a simple manner to control the tapping and, for example, slow down the tapping when needed, thus making the arrangement well connectible to, for example, a continuous casting machine.

Figure 1:
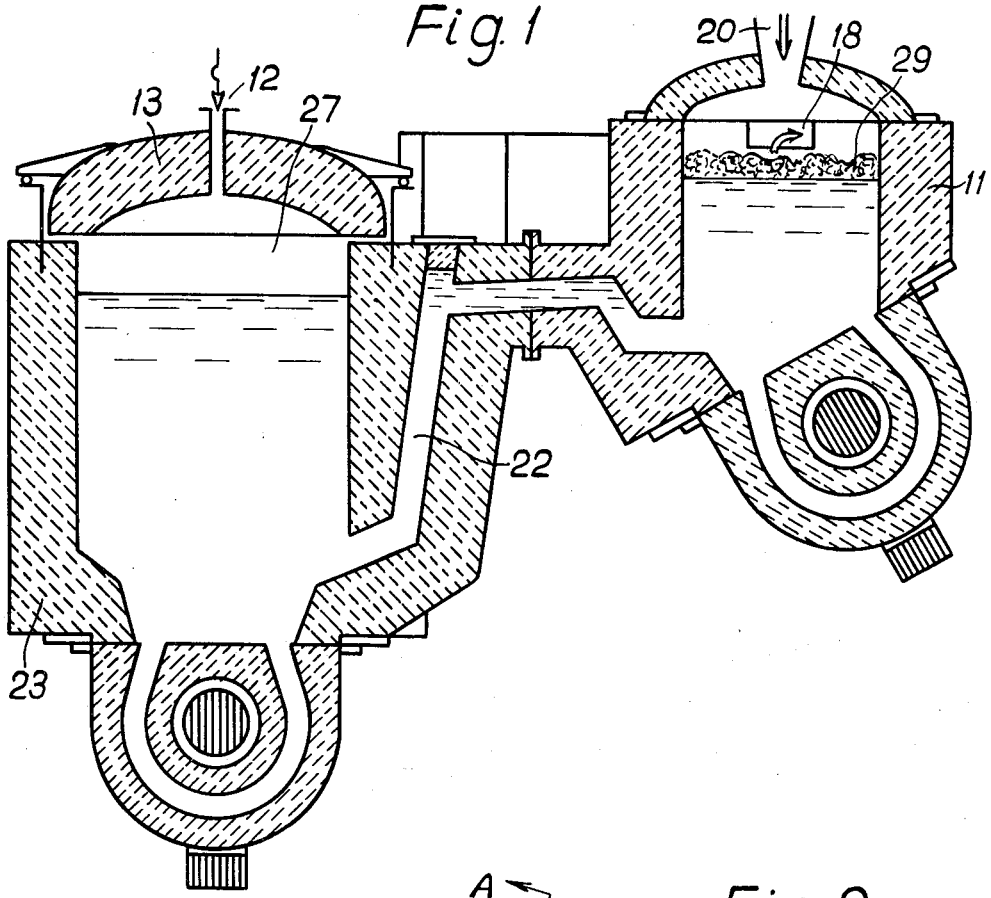
Figure 2:
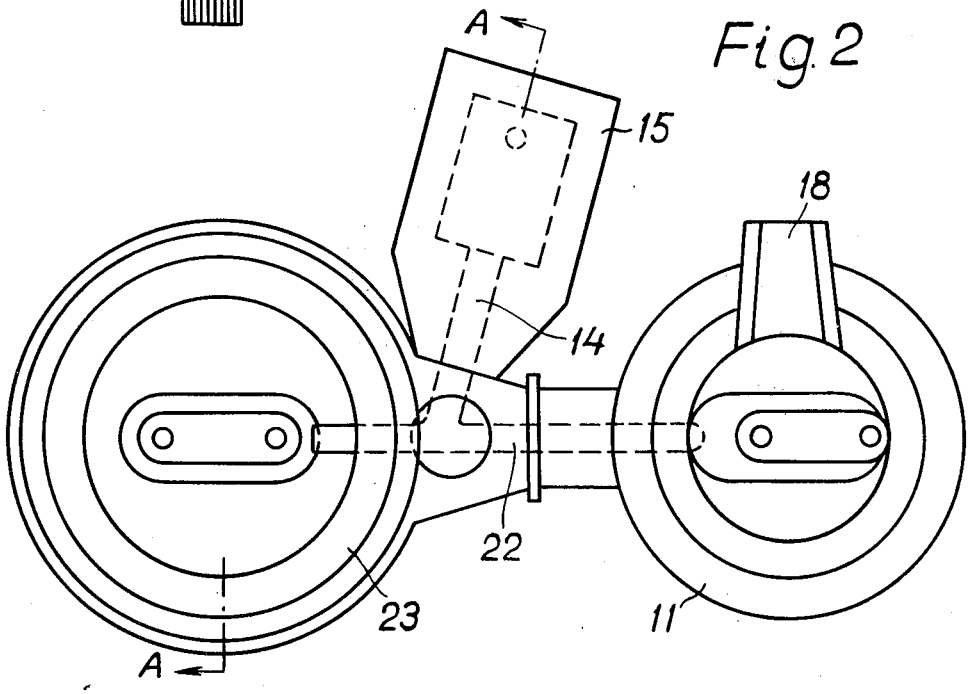
Figure 3:
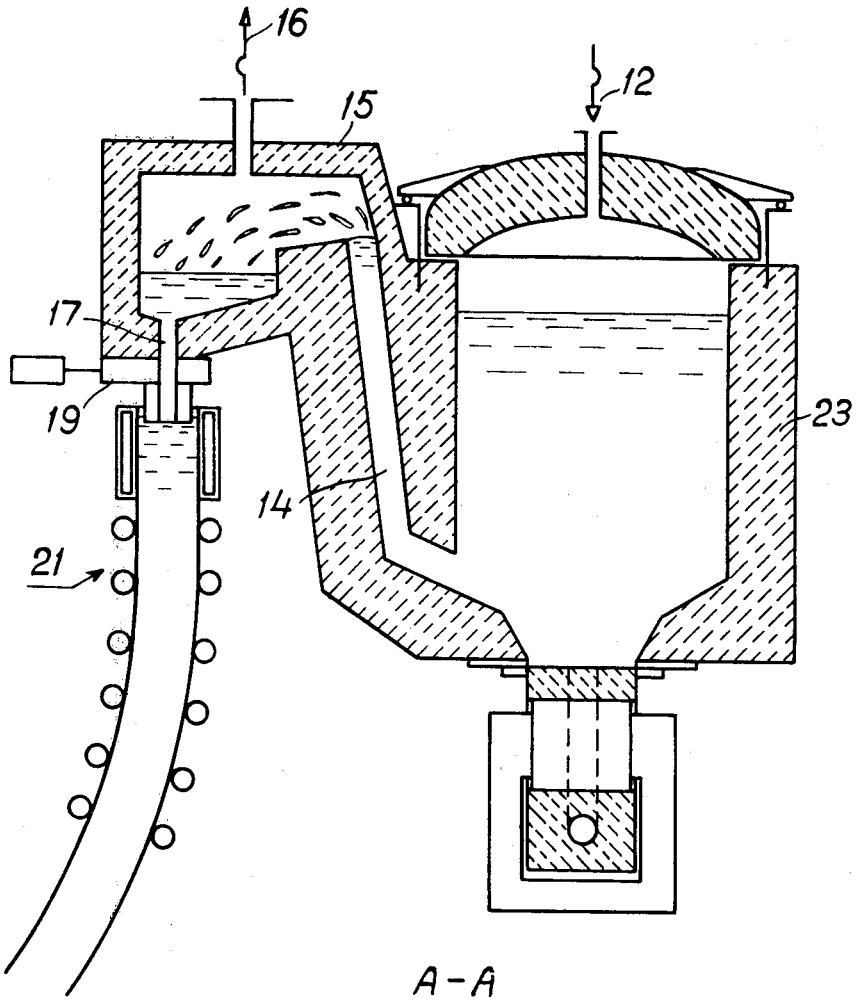

These and other advantages of the invention are more closely described below and in the accompanying drawings, of which FIG. 1 shows a combination of channel-type induction furnaces in cross-section and FIG. 2 the same plant seen from above with the tundish visible, whereas FIG. 3 shows a section along the line A—A in FIG. 2, where the tundish is connected to a continuous casting machine.

As is clear from the above-mentioned earlier application, the melting furnace 11 is charged at the charging member 20, which is intended for charging solid material such as brass or aluminium chips, but also other solid or molten charge may be used, also consisting of ferrous metals. At 18 there is shown an opening for deslagging (see FIG. 1 and 2). To the relatively small channel-type induction furnace 11 there is connected a second and substantially larger channel-type induction furnace 23 (or several furnaces) by way of a feeding channel 22, said second furnace 23 like the first furnace 11 being provided with one or more inductors of single or double-channel type of conventional kind. The furnace 23 is provided with a pressure-tight cover 13, in which there is/are arranged one or more supply conduits 12 for pressure medium intended to be used for pressure tapping of the furnace 23, which thus operates as a pressure tapping furnace. As is clear from the above-mentioned earlier application there is suitably connected a tapping portion 14 in the feeding channel 22 or in some other place within the combination of furnaces. By raising the pressure at 12 it is thus possible to control the tapping through the tapping portion 14, and after closing the tapping portion 14 it is also possible to raise or lower the slag level at 29 in the melting furnace 11.

Now, however, with this invention it is desired to be able to control the tapping process in a selective way, so that, for example, the means can be connected to a casting machine or some other casting station where a carefully balanced tapping is desired. By means of this invention a tundish 15 (FIG. 2 and 3) is connected to the tapping portion, and by controlling the pressure at 12 in the pressure tapping furnace 23 the supply of melt to the tundish 15 can be varied. The tapping conduit 14 does not necessarily have to be connected to the feeding channel 22, but can also open out in some other place in the pressure tapping furnace 23. However, it is often suitable to have it arranged in the feeding channel 22. At the tundish 15 there is arranged one or more evacuation conduits 16 leading to one or more suitable vacuum pumps (not shown). The tundish 15 is also provided with one or more pouring holes 17 which are closable by means 19 of a suitable valve means, suitably sliding or turning. This valve means (not shown) can of course also be complemented with an electromagnetic valve means. In the shown case a continuous casting machine 21 is connected to the pouring hole 17, but the tapping may of course be carried out to another suitable casting station.

It is desirable to control the tapping through the tapping conduit 14 and the tundish 15 by varying the sub-atmospheric pressure above the melt in the tundish by means of the evacuation conduit 16. If the sub-atmospheric pressure is raised the tapping is reduced and vice versa, and in this way the tapping to the casting station 21 can be easily controlled. The control of the sub-atmospheric pressure above the melt surface in the tundish may be performed, for example, by means of a level meter in the casting machine 21 or by using a weighing device in an intermediate ladle or in a pouring ladle, the output signal of which is able to control the degree of evacuation at 16.

The tundish can suitably be equipped with heating members (not shown), suitably arranged near the pouring hole with a view to preventing freezing of the melt in the tundish 15. The tundish can further be shaped in the form of a crucible or channel-type induction furnace in which case also heating members are obtained in the tundish. Apart from evacuation conduits and pouring holes the tundish is closed.

In the shown case the tapping conduit 14 opens out into the tundish 15 at a level which is higher than the melt level in the tundish. If vacuum is arranged above the melt surface in the tundish 15 the transfer of melt from the tapping conduit 14 to the tundish 15 is obtained in the form of droplets, and, in cooperation with the sub-atmospheric pressure, a considerable amount of degassing of the melt which is transferred to the tundish is obtained, and a high quality is obtained for the melt which is to be cast. Coordination between the pressure at 12 in the pressure tapping furnace 23 and the sub-atmospheric pressure in the tundish 15 at 16 secures a very careful control of teeming rate and casting amounts. Of course also the control of the casting can be performed by means of the valve 19.

The possibility of arranging sub-atmospheric pressure of varying degrees in the tundish 15 also makes one substantially independent of the pressure in the pressure tapping furnace 23, for the pressure in this is used also for adjusting a suitable slag and melt level in the channel-type induction furnace 11.

The advantages derived from the means according to the above-mentioned earlier application are of course also obtained with the present arrangement, i.e. the plant is well suited for taking care of chips or other charge in the form of brass, aluminium, magnesium and its alloys. The plant is of course also exceptionally well suited for use when casting melts of iron or steel. The invention can be employed in combination with furnaces for continuous production of raw iron (worcra), where viscous raw iron is to be collected and superheated for a metallurgical treatment and subsequent casting in moulds or in continuous casting machines.

The invention can be varied in many ways within the scope of the following claims.

We claim:

1. Apparatus for forming metallic charging material into a melt and holding and tapping said melt, and comprising a first channel-type induction furnace having a melting hearth in which said melt is formed, a second channel-type induction furnace having a holding hearth in which said melt is held, a melt-feeding conduit connecting said melting hearth to said holding hearth and means for applying gas pressure on said melt in said holding hearth, said first furnace being small as compared to said second furnace and said second furnace being positioned at a lower level than said first furnace; wherein the improvement comprises a tapping conduit connecting with a bottom portion of said holding hearth and extending upwardly to an outlet at a level above the holding hearth, gas pressure on a melt in the holding hearth adjusting the level of a melt in the melting hearth and also forcing the melt in the holding hearth upwardly through said tapping conduit for tapping the melt from the holding hearth, an enclosed tundish into which the tapping conduit's outlet opens, said tundish having a pouring hole for a tapped melt forced into the tundish from the tapping conduit's outlet and the tundish forming an enclosed space above the tapped melt therein, and means for obtaining a sub-atmospheric pressure in said enclosed space and on the tapped melt in the tundish, to control the rate at which the tapped metal pours through the tundish's pouring hole.

2. The apparatus of claim 1 in which the tundish pouring hole has a valve.

* * * * *